US012049801B2

(12) United States Patent
Kabrich et al.

(10) Patent No.: US 12,049,801 B2
(45) Date of Patent: Jul. 30, 2024

(54) CONTROLLING OPERATIONS OF A HYDRAULIC FRACTURING SYSTEM TO CAUSE OR PREVENT AN OCCURRENCE OF ONE OR MORE EVENTS

(71) Applicant: Caterpillar Inc., Peoria, IL (US)

(72) Inventors: Todd R. Kabrich, Tomball, TX (US); Andy Publes, Katy, TX (US); Casey A. Otten, Spring, TX (US); Brandon J. Mabe, Houston, TX (US); Perry D. Converse, Lafayette, IN (US); Jason T. Herlehy, The Woodlands, TX (US); Joseph C. Bufkin, Spring, TX (US)

(73) Assignee: Caterpillar Inc., Peoria, IL (US)

( * ) Notice: Subject to any disclaimer, the term of this patent is extended or adjusted under 35 U.S.C. 154(b) by 175 days.

(21) Appl. No.: 17/692,931

(22) Filed: Mar. 11, 2022

(65) Prior Publication Data

US 2023/0287760 A1 Sep. 14, 2023

(51) Int. Cl.

| | |
|---|---|
| ***E21B 34/02*** | (2006.01) |
| ***E21B 43/26*** | (2006.01) |
| ***E21B 47/06*** | (2012.01) |

(52) U.S. Cl.

CPC ..... *E21B 34/025* (2020.05); *E21B 43/2607* (2020.05); *E21B 47/06* (2013.01)

(58) Field of Classification Search

CPC ..... E21B 34/05; E21B 43/2607; E21B 47/06
See application file for complete search history.

(56) References Cited

U.S. PATENT DOCUMENTS

| | | | |
|---|---|---|---|
| 6,257,332 | B1 | 7/2001 | Halliburton |
| 8,205,594 | B2 | 6/2012 | Fore et al. |
| 9,255,531 | B2 | 2/2016 | Zhang et al. |
| 9,683,503 | B2 | 6/2017 | Zhang et al. |
| 9,889,915 | B2 | 2/2018 | Zhang et al. |
| 9,896,982 | B1 | 2/2018 | Zhang et al. |
| 9,970,278 | B2 | 5/2018 | Broussard et al. |

(Continued)

OTHER PUBLICATIONS

Unpublished U.S. Appl. No. 17/110,415, filed Dec. 3, 2020, available through USPTO IFW System (Copy not provided per Waiver of the Copy Requirement in 37 CFR 1.98 for Cited Pending U.S. Patent Applications).

(Continued)

*Primary Examiner* — Aaron L Lembo
(74) *Attorney, Agent, or Firm* — Bookoff McAndrews, PLLC

(57) ABSTRACT

A method may include monitoring an operation or a state of one or more subsystems of a hydraulic fracturing system. The hydraulic fracturing system may include one or more fracturing rigs, one or more blending equipment, and one or more power sources electrically connected to a first subset of the one or more fracturing rigs, or one or more fuel sources fluidly connected to a second subset of the one or more fracturing rigs. The hydraulic fracturing system may further include one or more missile valves, one or more zipper piping and zipper valve sets, one or more well head valves, and one or more well heads. The method may further include controlling, based on monitoring the operation or the state, the one or more subsystems within operating limits or based on operating expectations to cause or prevent an occurrence of one or more well integrity-related events.

20 Claims, 5 Drawing Sheets

(56) References Cited

U.S. PATENT DOCUMENTS

| | | | | |
|---|---|---|---|---|
| 9,981,866 | B2 * | 5/2018 | Munisteri | B01D 17/04 |
| 10,408,031 | B2 | 9/2019 | Oehring et al. | |
| 10,415,348 | B2 | 9/2019 | Zhang et al. | |
| 10,458,352 | B2 | 10/2019 | Zhang et al. | |
| 10,563,649 | B2 | 2/2020 | Zhang et al. | |
| 10,734,814 | B2 | 8/2020 | Converse et al. | |
| 10,760,996 | B2 | 9/2020 | Converse et al. | |
| 10,890,061 | B2 | 1/2021 | Cai et al. | |
| 10,927,774 | B2 | 2/2021 | Cai et al. | |
| 11,187,066 | B2 * | 11/2021 | Aljindan | E21B 47/06 |
| 11,236,739 | B2 * | 2/2022 | Yeung | H02J 9/062 |
| 11,466,680 | B2 * | 10/2022 | Yeung | F04B 23/04 |
| 11,549,348 | B2 * | 1/2023 | Cicci | F04B 23/04 |
| 11,585,200 | B1 * | 2/2023 | Startz | E21B 43/2607 |
| 2013/0233560 | A1 | 9/2013 | Davidson | |
| 2017/0012439 | A1 | 1/2017 | Zhang et al. | |
| 2017/0130712 | A1 | 5/2017 | Zhang et al. | |
| 2018/0283102 | A1 * | 10/2018 | Cook | E21B 7/02 |
| 2018/0347312 | A1 | 12/2018 | Green et al. | |
| 2019/0112910 | A1 * | 4/2019 | Oehring | E21B 43/2607 |
| 2021/0025383 | A1 * | 1/2021 | Bodishbaugh | F04B 47/02 |
| 2021/0396117 | A1 * | 12/2021 | Yeung | E21B 43/2607 |
| 2022/0003229 | A1 * | 1/2022 | Mu | F04B 17/06 |
| 2022/0214474 | A1 * | 7/2022 | Nistala | E21B 43/00 |
| 2023/0035513 | A1 * | 2/2023 | Weber | B01D 19/00 |

OTHER PUBLICATIONS

Unpublished GB Patent Application No. 2105452.3, filed Apr. 16, 2021, copy provided with this SB08.

* cited by examiner

CONTROLLING OPERATIONS OF A HYDRAULIC FRACTURING SYSTEM TO CAUSE OR PREVENT AN OCCURRENCE OF ONE OR MORE EVENTS

TECHNICAL FIELD

The present disclosure relates generally to a hydraulic fracturing system, and more particularly, to controlling operations of a hydraulic fracturing system to cause or prevent an occurrence of one or more events.

BACKGROUND

Hydraulic fracturing is a means for extracting oil and gas from rock, typically to supplement a horizontal drilling operation. In particular, high-pressure fluid is used to fracture the rock, stimulating the flow of oil and gas through the rock to increase the volumes of oil or gas that can be recovered. A hydraulic fracturing rig used to inject high-pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at the same or different pressures to achieve a flow rate for the fluid (e.g., measured in barrels per minute). However, operation of the hydraulic fracturing system often involves the use of human operators to control operation of the hydraulic fracturing system, to respond to changing conditions at a fracturing site, and/or the like. These operators often have to be present on site and often have to be present in the field to perform these activities. This places the safety of the operator at risk, may not allow for sufficiently fast response time, and/or the like.

U. S. Patent Publication No. 2018/0347312, published on Dec. 6, 2018 ("the '312 publication") describes that a downhole flow control device provides a means for monitoring and autonomously controlling the fluid production from a well. The flow control device responds directly to changes in the downhole environment by changing the flow path through the valve as well conditions change without intervention from the surface of the well. However, the '312 publication does not disclose monitoring and controlling various subsystems of a hydraulic fracturing system, e.g., valves, blending equipment, hydraulic fracturing rigs, etc. to cause or prevent an occurrence of an event.

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves. The hydraulic fracturing system may further include a controller configured to monitor an operation or a state of one or more subsystems of the hydraulic fracturing system. The controller may be further configured to control, based on monitoring the operation or the state, the one or more subsystems within operating limits or based on operating expectations to cause or prevent an occurrence of one or more well integrity-related events.

In another aspect, a method may include monitoring an operation or a state of one or more subsystems of a hydraulic fracturing system. The hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to inlets and outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves. The method may further include controlling, based on monitoring the operation or the state, the one or more subsystems within operating limits or based on operating expectations to cause or prevent an occurrence of one or more well integrity-related events.

In yet another aspect, a controller for a hydraulic fracturing system may be configured to monitor an operation or a state of one or more subsystems of the hydraulic fracturing system. The hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves. The controller may be further configured to control, based on monitoring the operation or the state, the one or more subsystems within operating limits or based on operating expectations to cause or prevent an occurrence of one or more well integrity-related events.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
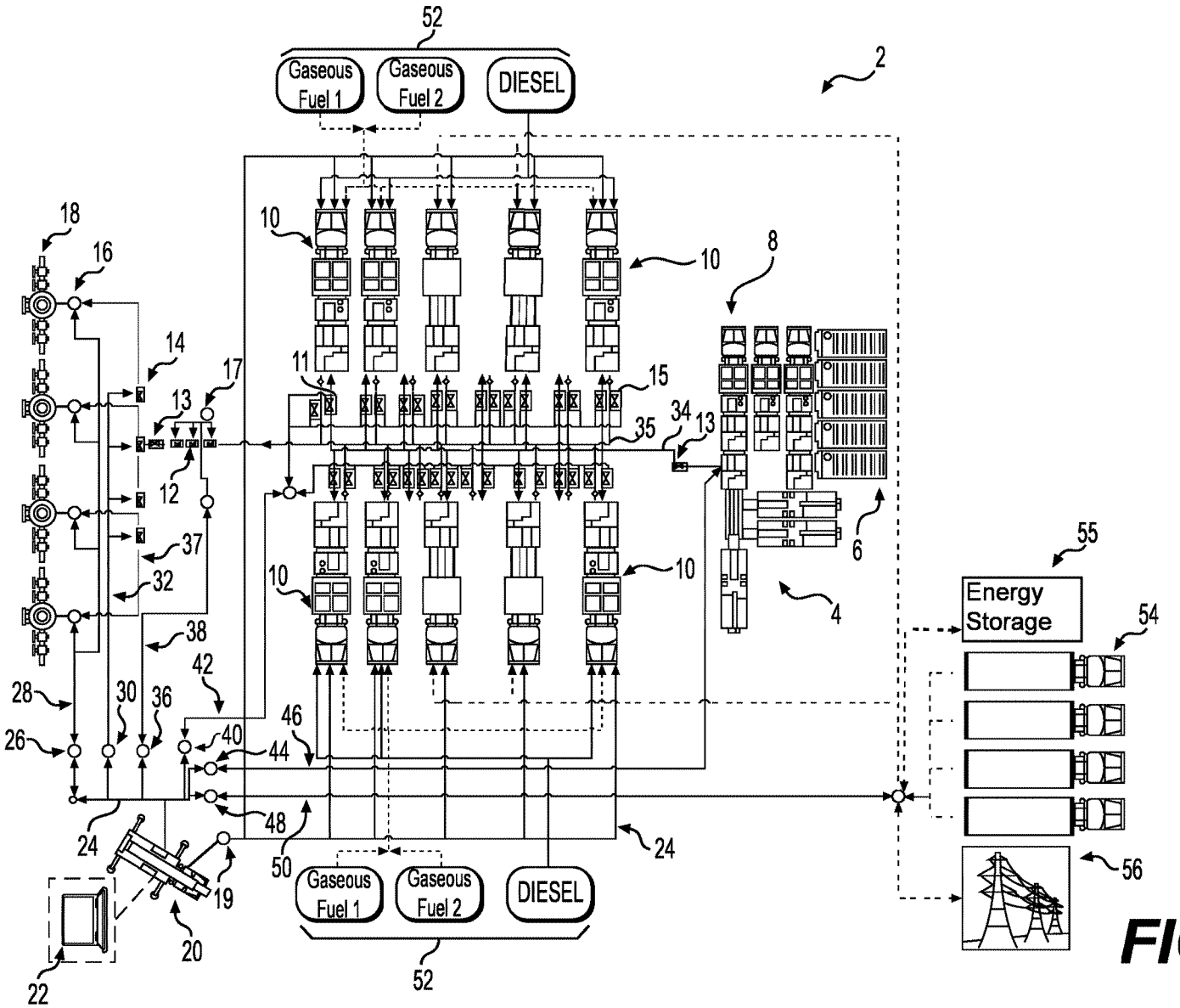
FIG. 1 is a schematic diagram of exemplary hydraulic fracturing systems including a plurality of fracturing rigs, energy sources, and fuel types according to aspects of the disclosure.

FIG. 1 illustrates an exemplary hydraulic fracturing system 2 according to aspects of the disclosure. In particular, FIG. 1 depicts an exemplary site layout according to a well stimulation stage (e.g., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at pressure through one or more low pressure fluid lines 34 to one or more fracturing rigs 10 (FIG. 1 illustrates ten fracturing rigs 10 and two types of fracturing rigs—4 electric fracturing rigs 10 and 6 hydraulic fracturing rigs 10). One or more types of fracturing rigs 10 may be used in connection with certain embodiments, such as mechanical fracturing rigs 10, hydraulic fracturing rigs 10, electric fracturing rigs 10, and/or the like. The one or more fracturing rigs 10 may pump the fracturing fluid at high pressure to a well head 18 (FIG. 1 illustrates four well heads 18) through one or more high-pressure fluid lines 35. The one or more fracturing rigs 10 may be controlled by one or more rig controllers 19 (e.g., a rig controller 19 may receive, process, and/or provide to the fracturing rigs 10 a desired flow or pressure for a job).

A bleed off tank (not shown in FIG. 1) may be provided to receive bleed off liquid or gas from the fluid lines 34 and/or 35 (e.g., via one or more automatic pressure relief valves 13). In addition, nitrogen, which may be beneficial to the hydraulic fracturing process for a variety of reasons, may be stored in tanks, with a pumping system (not shown in FIG. 1) used to supply the nitrogen from the tanks to the fluid lines 35 or a well head 18.

In order to control flow of fluid, the hydraulic fracturing system 2 may include various types of valves. For example, the hydraulic fracturing system 2 may include one or more low pressure missile valves 11 upstream from the inlet of hydraulic fracturing pumps of the fracturing rigs 10 (e.g., an inlet of the low pressure missile valves 11 may be fluidly connected to fluid lines 34 and outlets of the low pressure missile valves 11 may be fluidly connected to the inlets of the hydraulic fracturing pumps). For example, the low pressure missile valves 11 may control fluid flow from fluid lines 34 to the hydraulic fracturing pumps of the fracturing rigs 10. Additionally, or alternatively, the hydraulic fracturing system 2 may include one or more check valves 15 (e.g., actuated or one-way check valves 15) that may be upstream from a fracturing tree being served by the fracturing rigs 10 (e.g., outlets of the pumps of the fracturing rigs 10 may be fluidly connected to inlets of the check valves 15 and outlets of the check valves 15 may be fluidly connected to inlet(s) of the fracturing tree). Additionally, or alternatively, the hydraulic fracturing system 2 may include one or more large bore valves 12) of a grease system (FIG. 1 illustrates three large bore valves 12 (e.g., on/off ball valves). "Large bore" may refer to a line where flow is consolidated into one line and large bore valves 12 may shut the well off from missile lines. The hydraulic fracturing system 2 may include a system 17 that may gather data related to the hydraulic fracturing system 2 and may provide the data to the controller 58 for event correction and/or maintenance monitoring. For example, the controller 58 may track maintenance based on the data from the system 17 and may send a message to an operator or to the system 17 to grease the large bore valves 12, e.g., after a certain number of cycles of opening/closing the large bore valves 12. One or more other similar systems may be included in the hydraulic fracturing system 2 for monitoring operations of certain elements of the hydraulic fracturing system 2 and/or for taking corrective or maintenance-related actions. The large bore valves 12 may be downstream of outlets of the check valves 15 (e.g., inlets of the large bore valves 12 may be fluidly connected to outlets of the check valves 15). Additionally, or alternatively, the hydraulic fracturing system 2 may include one or more automatic pressure relief valves 13 (FIG. 1 illustrates one automatic pressure relief valve 13). For example, the automatic pressure relief valves 13 may be downstream of the one or more large bore valves 12 (e.g., inlets of the one or more automatic pressure relief valves 13 may be fluidly connected to outlets of the one or more large bore valves 12). The automatic pressure relief valves 13 may be controlled and/or triggered automatically to release fluid pressure from fluid lines 35. Additionally, or alternatively, the hydraulic fracturing system 2 may include one or more zipper valves 14 (FIG. 1 illustrates four zipper valves 14) downstream of the automatic pressure relief valves 13 (e.g., outlets of the automatic pressure relief valves 13 may be fluidly connected to inlets of the zipper valves 14). The zipper valves 14 may control fluid flow from fluid lines 35 to individual well heads 18 via zipper piping 37 (e.g., zipper piping may fluidly connect large bore valves 12 to the well heads 18). The hydraulic fracturing system 2 may further include one or more well head valves 16 (FIG. 1 illustrates four well head valves 16) downstream of the outlet of the zipper valves 14 (e.g., outlets of the zipper valves 14 may be fluidly connected to inlets of the well head valves 16). The well head valves 16 may provide further fluid control to the well heads 18 from the fluid lines 35.

The hydraulic fracturing process performed at the site, using the hydraulic fracturing system 2 of the present disclosure, and the equipment used in the process, may be managed and/or monitored from a single location, such as a data monitoring system 20, located at the site or at additional or alternative locations. According to an example, the data monitoring system 20 may be supported on a van, truck or may be otherwise mobile. As will be described below, the data monitoring system 20 may include a user device 22 for displaying or inputting data for monitoring performance and/or optimizing operation of the hydraulic fracturing system 2 and/or the fracturing rigs 10. According to one embodiment, the data gathered by the data monitoring system 20 may be sent off-board or off-site for monitoring, recording, or reporting of performance of the hydraulic fracturing system 2 (or elements of the hydraulic fracturing system 2) and/or for performing calculations related to the hydraulic fracturing system 2.

The data monitoring system 20 (or a controller of the data monitoring system 20) may be communicatively connected to one or more controllers of the hydraulic fracturing system 2 that control subsystems of the hydraulic fracturing system 2. For example, the data monitoring system 20 may be connected to the controllers via wired or wireless communication channels 24 The controllers may include a well head valve controller 26 connected to the one or more well head valves 16 and/or well heads 18 via a wired or wireless communication channel 28. The well head valve controller 26 may be configured to actuate the one or more well head valves 16 and/or one or more mechanical components of the well heads 18. Actuation of a valve or a well head 18 may include actuating one or more mechanical components to an open state, to a closed state, or to a partially closed or partially open state. Actuation, as described herein, may be performed by an associated actuator that may be integrated with the component to be actuated or may be a separate component (e.g., electric actuation of a valve may be performed through the use of an actuator integrated with a valve whereas hydraulic actuation may be performed through the use of an actuator located remote to the valve). Additionally, or alternatively, the controllers may include a zipper valve controller 30 connected to the one or more zipper valves 14 via a wired or wireless communication channel 32. The zipper valve controller 30 may be configured to actuate the one or more zipper valves 14.

The controllers may, additionally, or alternatively, include a large bore valve controller 36 connected to the one or more large bore valves 12 via a wired or wireless communication channel 38. The large bore valve controller 36 may be configured to actuate the one or more large bore valves 12. The controllers may further include a valve controller 40 connected to the one or more low pressure missile valves 11 and/or the one or more check valves 15 via a wired or wireless communication channel 42. The valve controller 40 may be configured to actuate the one or more low pressure missile valves 11 and/or the one or more check valves 15.

Additionally, or alternatively, the controllers may include a blender controller 44 connected to the blending equipment 8 via a wired or wireless communication channel 46. The blender controller 44 may be configured to control operations of the blending equipment 8 (e.g., to control preparation of the fracturing fluid). The controllers may further include a power source controller 48 connected to various power sources (e.g., generators 54, such as gaseous or blended generators 54, energy storages 55, such as batteries or fuel cells, and/or a utility power grid 56) included in the hydraulic fracturing system 2 via a wired or wireless communication channel 50. The generators 54 illustrated in FIG. 1 may be mobile generators 54 and may include turbine-based generators 54 or engine-based generators 54. Other power sources may include renewable energy sources, such as solar cells, wind turbines, and/or the like from a microgrid. The power source controller 48 may be configured to control one or more power sources and/or to control the provisioning of power from the power sources. For example, the power source controller 48 may power on or power off a generator 54 to meet power expectations, may switch one or more equipment of the hydraulic fracturing system 2 from consuming power from the utility power grid 56 to consuming power from one or more generators 54 and/or energy storages 55 (or vice versa), and/or the like.

Fuel sources 52 may provide fuel (e.g., gas, compressed natural gas (CNG), hydrogen (H2), propane, field gas, diesel, etc.) to the mechanical fracturing rigs 10. The provisioning of fuel to the fracturing rigs 10 may be controlled by a controller associated with the data monitoring system 20 and/or one or more other controllers associated with the fuel sources.

Generators 54 may provide energy to fracturing rigs 10. The provisioning of energy to the fracturing rigs 10 may be controlled by a controller associated with the data monitoring system 20 and/or one or more other controllers associated with the fuel sources.

Elements of the hydraulic fracturing system 2 may be configured to operate in one or more operational modes. The one or more operational modes may include a manual mode where, for example, an operator programs desired operational parameters for elements of the hydraulic fracturing system 2 via the user device 22 and the operator ramps the hydraulic fracturing system 2 to the desired operational parameters via the user device 22. In addition, in the manual mode, the operator may, via the user device 22, approve or decline optimized operational parameters determined by the data monitoring system 20 according to certain embodiments described herein. Additionally, or alternatively, the one or more operational modes may include a semi-closed mode where, for example, the operator ramps the hydraulic fracturing system 2 to desired operational parameters via the user device 22, and a controller 58 may optimize the operation of the hydraulic fracturing system 2 based on operator input (e.g., fuel optimization, emissions optimization, total cost of ownership optimization, and/or the like).

Additionally, or alternatively, the one or more operational modes may include a closed mode where, for example, the operator programs the desired operational parameters via the user device 22, and one or more controllers (e.g., controller 58 and/or controllers 64) ramp the operation of the hydraulic fracturing system 2 to the desired and/or optimized operational parameters. Additionally, or alternatively, the one or more operational modes may include an autonomous mode where, for example, the operator is remote to the data monitoring system 20 and/or a hydraulic fracturing site, and one or more controllers (e.g., controller 58 and/or controllers 64) may monitor and control the operational parameters of the hydraulic fracturing system 2 automatically (e.g., automatically ramp operation of the hydraulic fracturing system 2 to desired operational parameters, determine and implement optimized operational parameters, etc.). The autonomous mode may additionally include operating in the closed mode with sub-controllers for valves of the hydraulic fracturing system 2. Additionally, or alternatively, the one or more operational modes may include a multi-site mode where, for example, the operator can monitor and/or control operations of multiple hydraulic fracturing systems 2 at different sites. In some embodiments, the multi-site mode may include operating in the autonomous mode across multiple fracturing sites.

Figure 2:
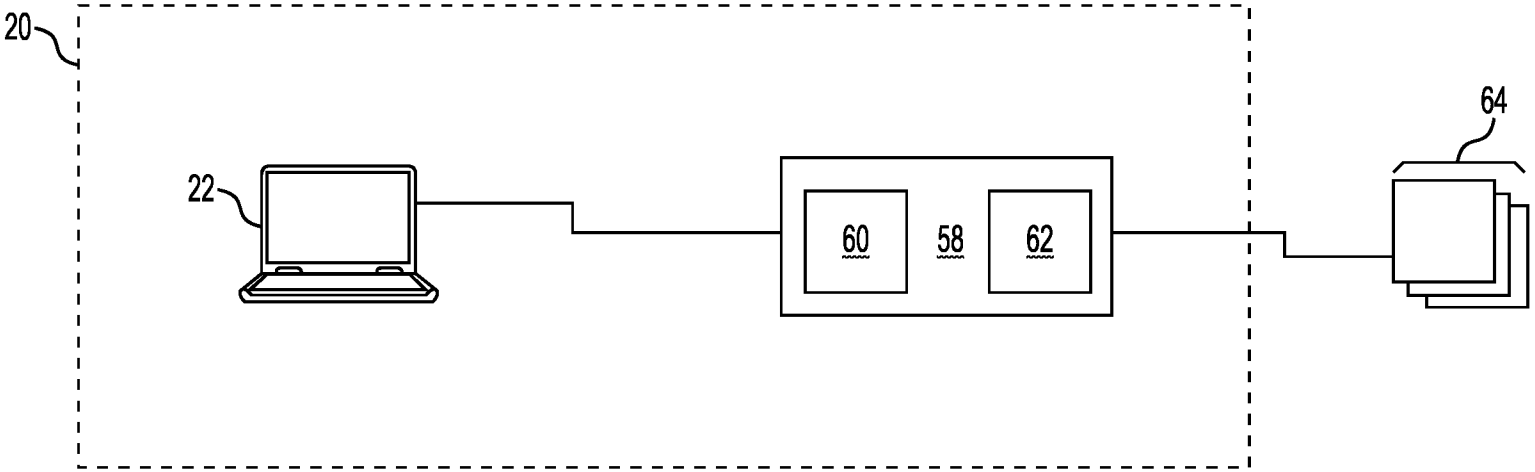
FIG. 2 is a schematic diagram of a data monitoring system and associated controllers of the hydraulic fracturing system of FIG. 1, according to aspects of the disclosure.

Referring to FIG. 2, the data monitoring system 20 may include the user device 22 and a controller 58. The controller 58 may be provided, and may be part of, or may communicate with, the data monitoring system 20. The controller 58 may reside in whole or in part at the data monitoring system 20, or elsewhere relative to the hydraulic fracturing system 2. The user device 22 and the controller 58 may be communicatively connected to each other via one or more wired or wireless connections for exchanging data, instructions, etc. Further, the controller 58 may be configured to communicate with one or more controllers 64 via wired or wireless communication channels. For example, the controller 58 may monitor and control, via the controllers 64, various subsystems of the hydraulic fracturing system 2. The controllers 64 may include the rig controller 19, the well head valve controller 26, the zipper valve controller 30, the large bore valve controller 36, the valve controller 40, the blender controller 44, and/or the power source controller 48.

The controllers 64 may be configured to communicate with one or more sensors (not shown in FIG. 2) located on elements of the hydraulic fracturing system 2. For example, the valve controller 40 may be configured to communicate with one or more sensors located at one or more valves, at components (e.g., an engine, a pump, etc.) of a fracturing rig 10, etc. A sensor may be configured to detect or measure one or more physical properties related to operation and/or performance of the various elements of the hydraulic fracturing system 2. For example, a sensor may be configured to provide a sensor signal indicative of a state of a valve (e.g., open, closed, a percentage open, or a percentage closed) to one or more of the controllers 64, which may be configured to provide the sensor signal to the controller 58.

The controller 58 and/or the controllers 64 may include a processor and a memory (not illustrated in FIG. 2). The processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor may possess its own local memory, which also may store program modules, program data, and/or one or more operating systems. The processor may include one or more cores.

The memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 22, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the controller 58 and/or the controllers 64.

The memory may be capable of storing various computer readable instructions for performing certain operations described herein (e.g., operations of the controller 58 and/or the controllers 64). The instructions, when executed by the processor and/or the hardware logic component, may cause certain operations described herein to be performed.

The controller 58 may store and/or execute an optimization program 60 to optimize operations of the hydraulic fracturing system 2 (e.g., based on data stored in the memory or as otherwise provided to the controller 58, such as via the user device 22, gathered by the controllers 64, or from a database). The controller 58 may store and/or execute a control logic program 62 (as described in more detail below with respect to FIG. 4). Data used by the controller 58 may include site configuration-related information, scheduling-related information, cost-related information, emissions-related information, operation-related or state-related information, system operating parameters, and/or the like. However, various other additional or alternative data may be used.

Figure 3:
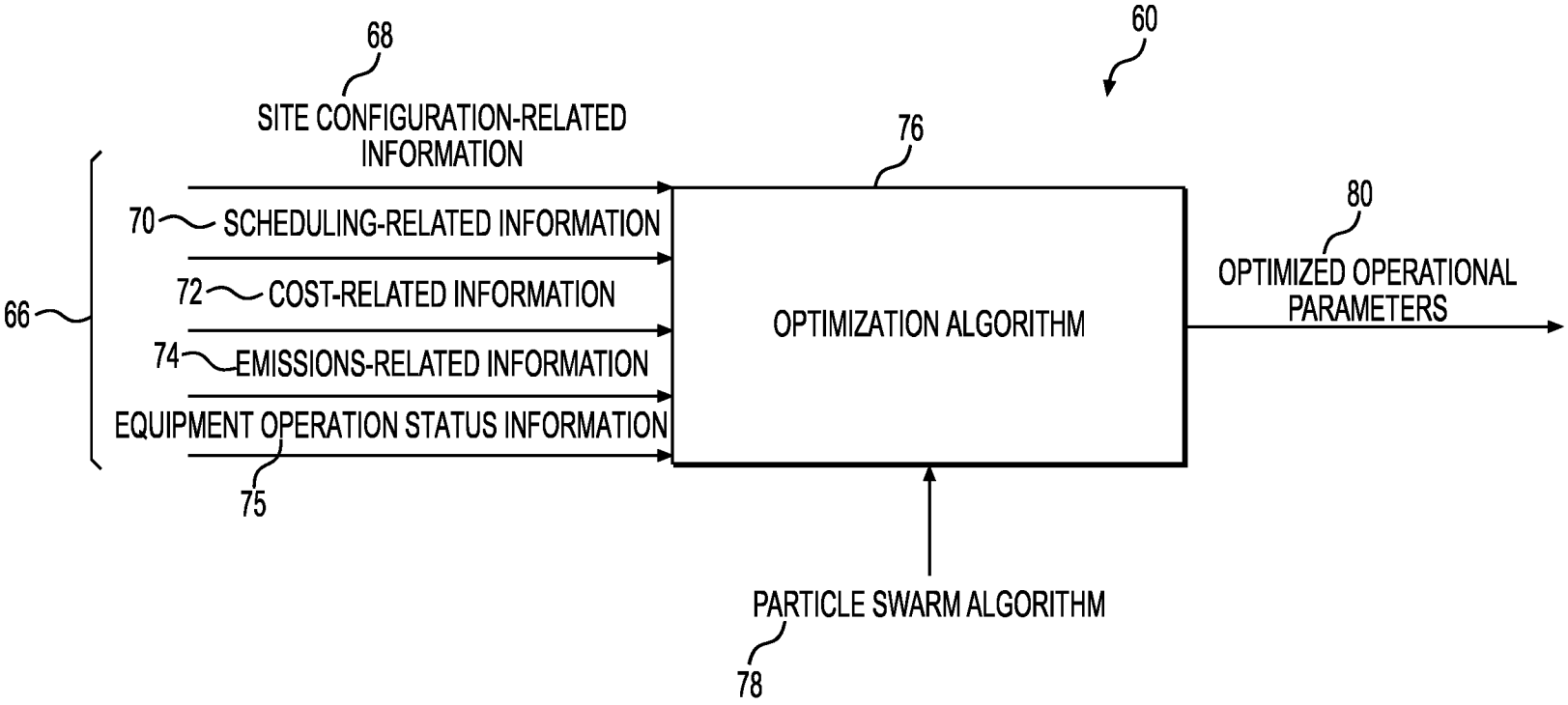
FIG. 3 is a diagram illustrating an exemplary optimization program, according to aspects of the disclosure.

FIG. 3 is a diagram illustrating an exemplary optimization program 60, according to aspects of the disclosure. As illustrated in FIG. 3, the optimization program 60 may receive input data 66 and may use the input data 66 with an optimization algorithm 76. For example, the optimization program 60 may receive the input data 66 from the user device 22 (e.g., a user may input the input data 66 via the user device 22), from a server device, from a database, from memory of various equipment or components thereof of the hydraulic fracturing system 2, and/or the like. The optimization program 60 may receive the input data 66 as a stream of data during operation of the hydraulic fracturing system 2, prior to starting operations of the hydraulic fracturing system 2, and/or the like. The input data 66 may be predetermined and provided to the optimization program 60 (e.g., may be based on experimental or factory measurements of equipment), may be generated by the controller 58 (e.g., the controller 58 may broadcast a ping communication at a site in order to receive response pings from equipment at the site to determine which equipment is present, the controller 58 may measure, from sensor signals, the input data 66, etc.), and/or the like.

The input data 66 may include site configuration-related information 68. For example, the site configuration-related information 68 may include numbers and/or types of elements of the hydraulic fracturing system 2, powertrain types of the fracturing rigs 10 (e.g., mechanical or electric powertrain configurations), sub-types of mechanical powertrains (e.g., fuel types or levels of emission certified combustion engines), sub-types of electric powertrains (e.g., turbine generators, reciprocating engine generators, hydrogen fuel cells, energy storage systems, such as batteries, or direct-to-grid), possible operating modes of the elements of the hydraulic fracturing system 2 (e.g., a manual mode, a semi-closed mode, a closed mode, an autonomous mode, etc.), a maximum allowed pressure or flow rate of a fracturing rig 10 at the site, quantities and/or types of other equipment located at the site, ages, makes, models, and/or configurations of the equipment at the site, and/or the like. Additionally, or alternatively, the input data 66 may include scheduling-related information 70. For example, the scheduling-related information 70 may include times, dates, durations, locations, etc. for certain operations of the hydraulic fracturing system 2, such as scheduled times and dates for certain pump pressures, scheduled openings or closings of valves, etc.

Additionally, or alternatively, the input data 66 may include cost-related information 72. For example, the cost-related information 72 may include a cost of fuel or power for the hydraulic fracturing system 2, a total cost of ownership of elements of the hydraulic fracturing system 2 (e.g., including maintenance costs, costs of fracturing fluid, or personnel costs), a cost of emissions (e.g., regulatory costs applied to emissions or costs related to reducing emissions, such as diesel exhaust fluid (DEF) costs), and/or the like. Additionally, or alternatively, the input data 66 may include emissions-related information 74. For example, the emissions-related information 74 may include an amount of emissions from elements of the hydraulic fracturing system 2 (e.g., at different operating levels of the equipment), and/or the like. Additionally, or alternatively, the input data 66 may include equipment operation status information 75. For example, the equipment operation status may include an operational mode of equipment of the hydraulic fracturing system 2, such as for verification of requests to change the operational status of the equipment. The input data 66 may include various other types of data depending on the objective to be optimized by the optimization algorithm 76. For example, the input data 66 may include transmission gear life predictions, pump cavitation predictions, pump life predictions, engine life predictions, and/or the like.

As described in more detail herein, the optimization algorithm 76 may process the input data 66 after receiving the input data 66. For example, the optimization algorithm 76 may process the input data 66 using a particle swarm algorithm 78. The optimization algorithm 76 may then output optimized operational parameters 80 for the hydraulic fracturing system 2 to the user device 22 for viewing or modification, to the controller 58 and/or the controllers 64 to control operations of the hydraulic fracturing system 2, and/or to a database for storage. Optimized operational parameters 80 may include, for example, values for engine power output, gear ratio, engine revolutions, throttle control, pump pressure, flow rate, or transmission speed optimized for emissions output, fuel consumption, lowest cost of operation, and/or the like.

Figure 4:
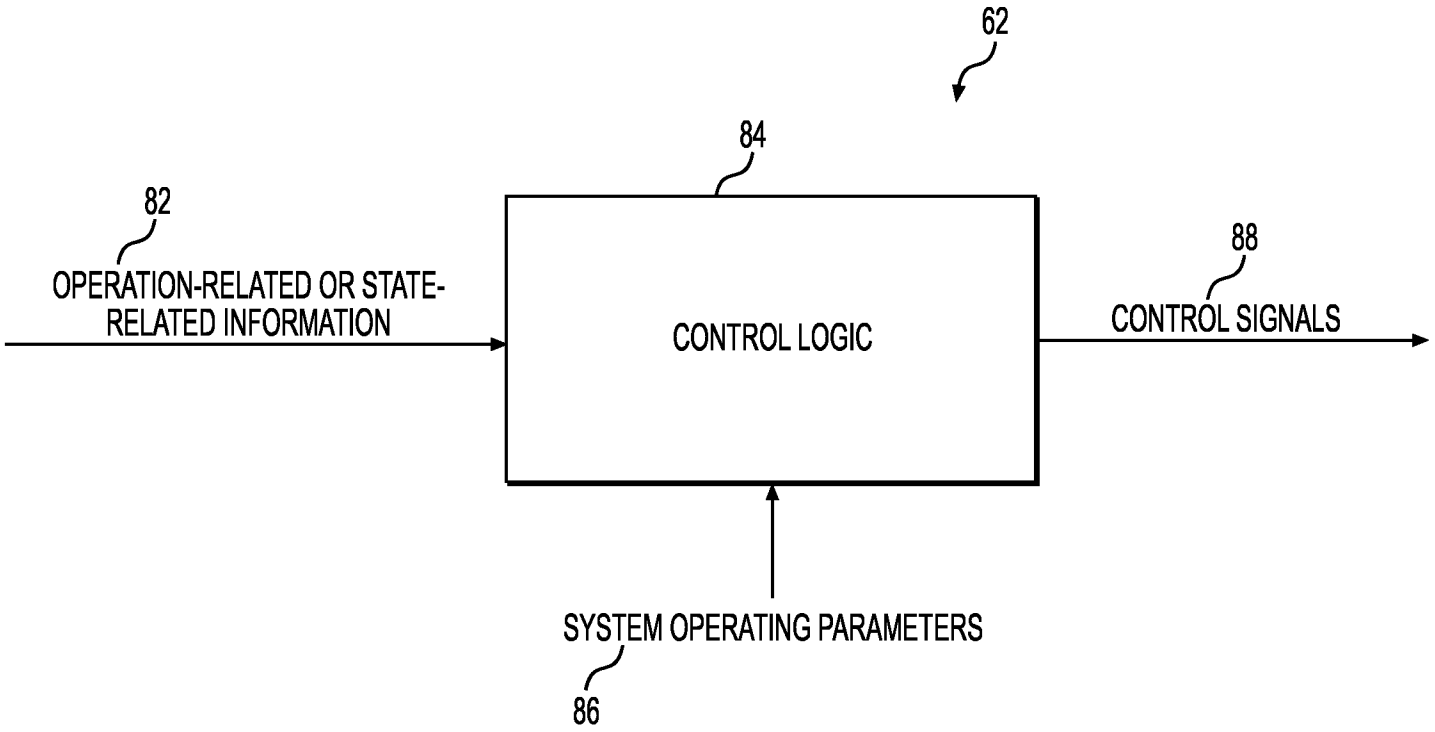
FIG. 4 is a diagram illustrating an exemplary control logic program, according to aspects of the disclosure.

FIG. 4 is a diagram illustrating an exemplary control logic program 62, according to aspects of the disclosure. As illustrated in FIG. 4, the control logic program 62 may receive operation-related or state-related information 82 and may provide this information to control logic 84. The operation-related or state-related information may include, for example, an operating pressure at a well head 18 or other elements of the hydraulic fracturing system 2, an operating transmission gear or speed of mechanical fracturing rigs 10 or power consumption of electric fracturing rigs 10, a fuel or power consumption rate or elements of the hydraulic fracturing system 2, a mixture of the fracturing fluid, whether certain types of elements or certain instances of certain types of elements are in operation, whether valves are opened or closed (or a degree to which they are opened or closed), and/or the like.

The control logic program 62 may process the operation-related or state-related information 82 using control logic 84. For example, the control logic 84 may be based on system operating parameters 86, which may include operating limits, operating expectations, operating baselines, and/or the like for the hydraulic fracturing system 2. The control logic 84 may then output control signals 88 based on the processing. For example, the control signals 88 may modify the operation of the hydraulic fracturing system 2 to avoid exceeding operating limits, to ramp operation of equipment to operating expectations, to ramp operation of equipment to exceed operating baselines, and/or the like.

Industrial Applicability

The aspects of the controller 58 of the present disclosure and, in particular, the methods executed by the controller 58 may be used to assist in monitoring and controlling operations of various subsystems of a hydraulic fracturing system 2. Thus, certain aspects described herein may provide various advantages to the operation of the hydraulic fracturing system 2, such as helping to control operations so that certain events, such as over limiting pressure or well collapse, do not occur. In addition, the controller 58 may monitor and control operations of multiple different subsystems at the same time (based on real-time or near real-time information), in a way very difficult or not possible through operator-based operation of the hydraulic fracturing system 2. This may increase an efficiency of fracturing operation of the hydraulic fracturing system 2. Additionally, or alternatively, the controller 58 may shut off a fracturing rig 10 if a particle swarm algorithm determines that the best operation is to shut down a fracturing rig 10 and to have other fracturing rigs 10 assume the load. Similarly, the controller 58 may automatically shut down a fracturing rig 10 due to mechanical events to protect the equipment from damage.

In certain embodiments, if the controller 58 determines that a fracturing rig 10 is no longer needed to achieve a target pressure and/or flow, the controller 58 may send various commands to shut down the fracturing rig 10 and/or to close certain valves (e.g., certain valves 11) to prevent clogging. These determinations and/or commands may be based on data from or communications with the controllers 64. Additionally, or alternatively, the controller 58 may have safe start and/or shutdown sequences based on data gathered from the controllers 64. For example, the controller 58 may detect that the operations of a fracturing rig 10 violate one or more safety limits, total site capability limits, or flow capacity limits, and the controller 58 may safely shut down the fracturing rig 10 or safely start up another fracturing rig 10. As another example, the controller 58 may shut down or start equipment at a site for equipment protection (e.g., based on detecting events that would lead to failure by processing data from the equipment). As another example, the controller 58 may shut down or start equipment at a site based on an optimized desired state of operation (e.g., a state optimized for fuel consumption, emissions, total cost of ownership (TCO), and/or the like). Continuing with the previous example, the particle swarm algorithm 78 may output commands based on certain controls being configured to prevent clogs in equipment of the hydraulic fracturing system 2. Preventing clogs during operation can reduce or eliminate significant failures of a pump that may occur as a result of trying to unclog the pump. Safely shutting down or starting up equipment may include, e.g., configuring valves, controlling pressure ramp, and/or the like such that the shut down or start up does not cause damage to elements of the hydraulic fracturing system 2.

Additionally, or alternatively, in certain embodiments, if the controller 58 detects abnormal vibrations through monitoring pump information from a first fracturing rig 10, the controller 58 may determine to power on back-up equipment (e.g., a second fracturing rig 10) to protect the first fracturing rig 10 from damage. Additionally, or alternatively, the controller 58 may monitor usage of elements of the hydraulic fracturing system 2 and may generate commands or notifications for maintenance based on maintenance rules. As a specific example, the controller 58 may monitor open/close cycles of various valves (e.g., large bore valves 12) and may send a command to a grease system to grease the valves after a certain number of cycles.

Figure 5:
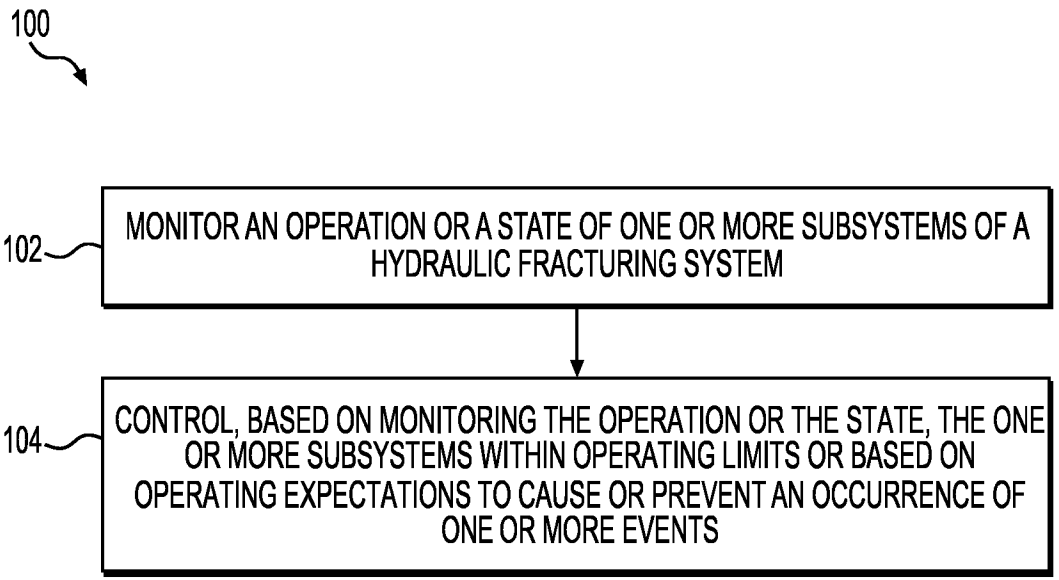
FIG. 5 illustrates a flowchart depicting an exemplary method for monitoring and controlling one or more subsystems of a hydraulic fracturing system, according to aspects of the disclosure.

FIG. 5 illustrates a flowchart depicting an exemplary method 100 for monitoring and controlling operations of a hydraulic fracturing system, according to aspects of the disclosure. The method 100 illustrated in FIG. 5 may be implemented by the controller 58. The steps of the method 100 described herein may be embodied as machine readable and executable software instructions, software code, or executable computer programs stored in a memory and executed by a processor of the controller 58. The software instructions may be further embodied in one or more routines, subroutines, or modules and may utilize various auxiliary libraries and input/output functions to communicate with other equipment. The method 100 illustrated in FIG. 5 may also be associated with an operator interface (e.g., a human-machine interface, such as a graphical user interface (GUI)) through which an operator of the hydraulic fracturing system 2 may configure the optimization algorithm 76 and/or the control logic 84, may select the input data 66, the operation-related or state-related information 82, may set objectives for the optimization algorithm 76 (e.g., objectives for the particle swarm algorithm 78), and/or the like. Therefore, the method 100 may be implemented by the controller 58 to cause or prevent certain events from occurring.

At step 102, the controller 58 may monitor an operation or a state of one or more subsystems of a hydraulic fracturing system 2. For example, the controller 58 may receive the operation-related or state-related information 82 as a stream of data, according to a schedule, etc. The controller 58 may receive the operation-related or state-related information 82 from a sensor, from one or more of the controllers 64, as input via the user device 22, from a server device, and/or the like. In connection with the monitoring at step 102, the controller 58 may additionally receive a configuration of the system operating parameters 86 via the user device 22, from memory, from a server device, from a remote control center, and/or the like.

A subsystem may include the blending equipment 8, the fracturing rigs 10 (e.g., mechanical and/or electric fracturing rigs 10), components of the fracturing rigs 10 (e.g., engines, pumps, transmissions, etc. for mechanical fracturing rigs 10 or variable frequency drives (VFDs) and electric motors for electric fracturing rigs 10), the low pressure missile valves 11, the large bore valves 12, the zipper valves 14 and/or zipper piping 37 and zipper valve 14 sets, the check valves 15, the well head valves 16, the well heads 18, the well head valve controller 26, the zipper valve controller 30, the large bore valve controller 36, the valve controller 40, the power source controller 48, the fuel sources 52, the power sources, and/or the like.

At step 104, the controller 58 may control, based on monitoring the operation or the state, the one or more subsystems within operating limits or based on operating expectations to cause or prevent an occurrence of one or more events. For example, the controller 58 may control the one or more subsystems automatically based on determining that the one or more subsystems are not meeting operating expectations or are exceeding operating limits. The controller 58 may process the information received at step 102 using the control logic 84 to determine whether operational limits have been exceeded, whether the equipment of the hydraulic fracturing system 2 are operating at least at minimum operating baselines or within expected ranges, etc. For example, the controller 58 may perform a comparison of the operation-related or state-related information 82 to system operating parameters 86 and may determine that the hydraulic fracturing system 2 is not meeting operating expectations or is operating beyond operating limits. From this analysis, the controller 58 may determine which equipment, components of the equipment, etc. are causing an issue. For example, if the controller 58 determines that the fluid pressure at a well head 18 is exceeding a pressure limit and additionally determines that one or more zipper valves 14 are closed to a greater amount than expected, the controller 58 may determine that the excessively closed zipper valves 14 are the cause of the excess fluid pressure.

The controller 58 may then provide control signals 88 to the controllers 64 and/or directly to equipment of the hydraulic fracturing system 2 to modify the operations of the equipment. With respect to inclusion in control signals 88, the controller 58 may use a processor to generate control signals 88 and may output the control signals 88 to a controller 64 or to equipment of the hydraulic fracturing system 2 using a transceiver (or a transmitter) to cause the equipment to operate in a particular manner. In this way, the controller 58 may conserve equipment life, fuel, emissions, power, etc. of the hydraulic fracturing system 2. Additionally, or alternatively, the controller 58 may output operational parameters (or instructions for modifying operational parameters) to the controllers 64, and the controllers 64 may generate the control signals 88. In certain embodiments, the operational parameters output from the controller 58 may include optimized operational parameters 80 (e.g., the controller 58 may perform the optimization algorithm 76 prior to outputting control signals 88, as described in more detail elsewhere herein).

The one or more events may be related to well integrity during hydraulic fracturing operations. For example, the one or more events to be caused may include a well pressure meeting or maintaining a minimum well pressure, the well pressure being within a range of pressure values, an operation speed (e.g., transmission speed) of the one or more subsystems meeting or maintaining a minimum operation speed, the operation speed being within a range of speed values, and/or the like. The one or more events to be prevented may include, for example, the well pressure exceeding a pressure limit, a well collapse, stalling of the one or more subsystems, or a deviation from a fracturing schedule. Additionally, or alternatively, certain embodiments may prevent cavitation on a low pressure line due to blender equipment 8 not providing enough pressure. For example, the controller 58 may send an instruction to the blender equipment 8 to increase speed before pump speed is increased. Additionally, or alternatively, certain embodiments may control operational efficiency to prevent loss of fuel by controlling fuel pressure, prevent loss of blending by controlling gas pressure, and/or the like. Additionally, or alternatively, certain embodiments may prevent operational interruption of an electric fracturing rig 10 by preventing loss of power or voltage, preventing start up of an electric fracturing rig 10 before a power source is ready (e.g., by checking power prior to ramping), and/or the like.

As one specific example of the steps 102 and 104, the controller 58 may monitor information including an open or closed state of various valves of the hydraulic fracturing system 2, and controlling the valves to prevent exceeding a pressure limit in the hydraulic fracturing system 2 by pumping on a closed pathway. For example, the controller 58 may generate control signals 88 to actuate mechanical components of the valves to adjust the degree to which the valves are opened or closed. As another specific example of the steps 102 and 104, the controller 58 may monitor and control the blending equipment 8 to prevent the hydraulic fracturing system 2 from falling below a minimum suction pressure or from going lower than the low pressure limit of the system. For example, the controller 58 may generate control signals 88 to adjust a mixture of the fracturing fluid, an output flow rate of the blending equipment 8, and/or the like. As another specific example of the steps 102 and 104, the controller 58 may monitor and control the power sources (including auxiliary power sources) to help ensure that the power output from the power sources is sufficient to meet the power demand of the hydraulic fracturing system 2. For example, the controller 58 may monitor numbers and/or types of power sources that are on, off, or in standby (e.g., a mode where a power source is on and ready to output power if needed, such as in the event that another power source goes offline), the power output from the power sources (e.g., individual output from individual power sources, aggregate output from the various power sources, etc.), and/or the like in relation to expected power demand. The controller 58 may then generate control signals 88 to increase or decrease the power output from individual or aggregated power sources, to power on or off one or more power sources or certain types of power sources, to cause one or more power sources or certain types of power sources to enter a standby mode, and/or the like.

As another example of the steps 102 and 104, the controller 58 may monitor and control pumps of the fracturing rigs 10. For example, the controller 58 may monitor an output pressure or flow rate of the pumps (e.g., alone or in connection with pressures at the valves of the hydraulic fracturing system 2) and may generate control signals 88 to increase or decrease a flow rate or pressure from the pumps based on detected downstream pressures at the well heads 18. As another example, the controller 58 may monitor and control one or more subsystems within safety limits. For example, the controller 58 may, when the controller 58 detects that an operational parameter has exceeded a safety limit or is within a threshold percentage of the safety limit, generate control signals 88 to reduce certain operational parameters related to the safety limit, to cause a hard stop of certain equipment of the hydraulic fracturing system 2, and/or the like.

When monitoring or controlling the one or more subsystems, the controller 58 may perform automated event correction. For example, the controller 58 may detect (via sensors) and/or correct cavitation while operating the blender equipment 8 and the fracturing rig 10 in a closed mode. As another example, the controller 58 may send an instruction to reduce a flow of a pump and ramp up the flow of one or more other pumps (e.g., pumps closer to the blender equipment 8) to compensate for the reduced flow. Continuing with the example, the controller 58 may control the hydraulic fracturing system 2 within operational limits and customer limits while trying to maintain an overall flow and managing individual pumps to avoid cavitation. The controller 58 may perform diagnostics of the blender equipment 8 to identify feed issues, clog issues, and/or the like. Additionally, or alternatively, and as another example, the controller 58 may correct for a pressure spike by actuating one or more valves and controlling one or more fracturing rigs 10. As a specific example, if a valve is open and the pressure of the hydraulic fracturing system 2 is at a limit based on a pump speed, the controller 58 may diagnose the cause of the pressure spike as a clog in a line.

Additionally, or alternatively, the controller 58 may detect (via sensors) and/or correct for abnormal pump vibration. For example, the controller 58 may ramp down a pump experiencing abnormal pump vibrations and ramp up one or more other pumps. Additionally, or alternatively, the controller 58 may detect (via sensors) and/or correct mechanical power source derating. For example, the controller 58 may power down the mechanical power source and power up one or more other mechanical power sources. Additionally, or alternatively, the controller 58 may detect (via sensors) a failure of dynamic gas blending (DGB) and the controller 58 may send an instruction to power on an inactive DGB unit or redistribute load among other DGB units while staying within constraints.

Additionally, or alternatively, the controller 58 may prevent an electrical power source blackout/brownout. For example, for a mixed fleet of fracturing rigs 10, the controller 58 may manage load demand while not allowing an electric pump to exceed the power available. As another example, the controller 58 may manage electric power sources based on a schedule. Additionally, or alternatively, the controller 58 may detect (via sensors) and/or correct electric pump derating (e.g., excessive motor temperature, excessive VFD temperature, etc.). For example, the controller 58 may power down an electric pump that is experiencing issues and may power on one or more other electric pumps.

Although the method 100 illustrated in FIG. 5 is described as including steps 102 and 104, the method 100 may not include all of these steps or may include additional or different steps. For example, the method 100 may include optimizing operation of one or more subsystems of the hydraulic fracturing system 2 using a particle swarm algorithm or another type of optimization algorithm (e.g., a particle swarm algorithm may iteratively tune operational parameters to search for a set of optimized operational parameters 80 ($P_1$, $P_2$, . . . $P_n$) that achieve an optimization objective). In this way, "optimized," "optimization" and similar terms used herein may refer to selection of values (for operational parameters), based on some criteria (an objective), from a set of available values. An objective may be of any suitable type, such as minimizing the cost of fracturing operations of the hydraulic fracturing system 2, minimizing fuel or power consumption of the hydraulic fracturing system 2, minimizing emissions from the hydraulic fracturing system 2, maximizing an operational life of equipment of the hydraulic fracturing system 2, minimizing an overall time of the hydraulic fracturing operations, minimizing a cost of ownership of equipment used in the hydraulic fracturing operation, maximizing a maintenance interval of equipment of the hydraulic fracturing system 2, and/or any combinations thereof. In addition, and as another example, the method 100 may further include outputting optimized operational parameters 80. For example, the controller 58 may output the optimized operational parameters 80 to one or more destinations for display (e.g., for approval and/or modification by an operator), storage (e.g., for historical comparison or analysis, for later usage, etc.), inclusion into control signals (e.g., control signals 88 that cause elements of the hydraulic fracturing system 2 to operate according to the optimized operational parameters 80), and/or the like. The one or more destinations may include the user device 22 (or a display of the user device 22), a server device, a controller, a database, memory, etc.

In this way, the controller 58 of certain embodiments can provide real-time (or near real-time) monitoring and controlling one or more subsystems of one or more hydraulic fracturing systems 2 based on operating limits, operating expectations, and/or the like. This thereby improves operation of a hydraulic fracturing system 2 from a site-level perspective by facilitating automatic control of the hydraulic fracturing system 2 in response to real-time or near real-time conditions, which improves an efficiency of the operations. In addition, certain embodiments described herein may increase safety at a hydraulic fracturing system 2 by providing for faster responses to changing conditions across one or more fracturing sites that might cause adverse events to occur, by reducing or eliminating a need for human operators to be physically present at the site(s), and/or the like.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
one or more fracturing rigs;
one or more blending equipment fluidly connected to inlets of the one or more fracturing rigs;
one or more power sources electrically connected to a first subset of the one or more fracturing rigs, or one or more fuel sources fluidly connected to a second subset of the one or more fracturing rigs;
one or more missile valves fluidly connected to outlets of the one or more fracturing rigs;
one or more zipper piping and zipper valve sets fluidly connected to outlets of the one or more missile valves;
one or more well head valves fluidly connected to outlets of the one or more zipper piping and zipper valve sets;
one or more well heads fluidly connected to outlets of the one or more well head valves; and
a controller, wherein the controller is configured to:
monitor an operation or a state of one or more subsystems of the hydraulic fracturing system,
control, based on monitoring the operation or the state, the one or more subsystems within operating limits or based on operating expectations to cause or prevent an occurrence of one or more well integrity-related events, and
operate in a multi-site mode in which the controller monitors operations of multiple hydraulic fracturing systems.

2. The hydraulic fracturing system of claim 1, wherein the one or more subsystems comprise the one or more power sources, pumps of the one or more fracturing rigs, the one or more missile valves, the one or more well head valves, or the one or more zipper piping and zipper valve sets.

3. The hydraulic fracturing system of claim 1, wherein the controller is further configured to:
optimize the operation or the state of the one or more subsystems of the hydraulic fracturing system using a particle swarm algorithm prior to controlling the one or more subsystems.

4. The hydraulic fracturing system of claim 1, wherein the controller is further configured, when monitoring the operation or the state, to:
monitor an open or a closed state of the one or more missile valves, the one or more well head valves, or the one or more zipper piping and zipper valve sets; and
wherein the controller is further configured, when controlling the one or more subsystems, to:
control the one or more missile valves, the one or more well head valves, or the one or more zipper piping and zipper valve sets to prevent the hydraulic fracturing system from exceeding a pressure limit by pumping on a closed pathway.

5. The hydraulic fracturing system of claim 1, wherein the controller is further configured, when monitoring the operation or the state, to:
monitor a flow rate or an output pressure of the one or more blending equipment; and
wherein the controller is further configured, when controlling the one or more subsystems, to:
control the one or more blending equipment to prevent the hydraulic fracturing system from falling below a minimum suction pressure.

6. The hydraulic fracturing system of claim 1, wherein the controller is further configured to operate in one or more operational modes in addition to the multi-site mode, wherein the one or more operational modes comprise at least one of:
a closed mode in which the hydraulic fracturing system is configured to ramp the operation of the hydraulic fracturing system to desired operational parameters, or
a semi-closed mode in which an operator ramps the operation of the hydraulic fracturing system to desired operational parameters and the controller is configured to control operation of the hydraulic fracturing system based on operator input.

7. The hydraulic fracturing system of claim 1, wherein the controller, when controlling the one or more subsystems, is further configured to perform automated event correction.

8. The hydraulic fracturing system of claim 1, wherein the controller is further configured to operate in one or more operational modes in which an operator station for controlling the hydraulic fracturing system based on the one or more operational modes is accessed at a site or in a remote location.

9. The hydraulic fracturing system of claim 1, wherein the controller is further configured, when controlling the one or more subsystems, to:
control the one or more fracturing rigs to optimize the operation of the one or more fracturing rigs; and
automatically stop the operation of one or more running fracturing rigs or start the operation of one or more additional fracturing rigs.

10. The hydraulic fracturing system of claim 1, wherein the controller is further configured, when monitoring the operation or the state, to:
monitor output of the one or more power sources, wherein the one or more power sources comprise at least one auxiliary power source; and
wherein the controller is further configured, when controlling the one or more subsystems, to:
control the one or more power sources to meet a power demand of the hydraulic fracturing system.

11. A method, comprising:
monitoring an operation or a state of one or more subsystems of a hydraulic fracturing system, wherein the hydraulic fracturing system comprises:
one or more fracturing rigs,
one or more blending equipment fluidly connected to inlets of the one or more fracturing rigs,
one or more power sources electrically connected to a first subset of the one or more fracturing rigs, or one or more fuel sources fluidly connected to a second subset of the one or more fracturing rigs, one or more missile valves fluidly connected to inlets and outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves; and controlling, based on monitoring the operation or the state, the one or more subsystems within operating limits or based on operating expectations to cause or prevent an occurrence of one or more well integrity-related events, wherein the one or more well integrity-related events to be caused include at least one of:

a well pressure meeting or maintaining a minimum well pressure, the well pressure being within a range of pressure values, an operation speed of the one or more subsystems meeting or maintaining a minimum operation speed, or the operation speed being within a range of speed values, and wherein the one or more well integrity-related events to be prevented include at least one of:

the well pressure exceeding a pressure limit, a well collapse, stalling of the one or more subsystems, or a deviation from a fracturing schedule.

12. The method of claim 11, wherein the monitoring of the operation or the state further comprises:

monitoring an open or a closed state of the one or more missile valves, the one or more well head valves, or the one or more zipper piping and zipper valve sets; and wherein the controlling of the one or more subsystems further comprises:

controlling the open or the closed state of the one or more missile valves, the one or more well head valves, or the one or more zipper piping and zipper valve sets to prevent exceeding a pressure limit for the hydraulic fracturing system by pumping on a closed pathway.

13. The method of claim 11, further comprising:

optimizing the operation or the state of the one or more subsystems of the hydraulic fracturing system using a particle swarm algorithm.

14. The method of claim 11, wherein the monitoring of the operation or the state further comprises:

monitoring operational parameters of one or more pumps of the one or more fracturing rigs; and wherein the controlling of the one or more subsystems further comprises:

controlling the operational parameters of the one or more pumps based on the operating limits or the operating expectations.

15. The method of claim 11, wherein the monitoring of the operation or the state further comprises:

monitoring output of the one or more power sources, wherein the one or more power sources comprise one or more auxiliary power sources; and wherein the controlling of the one or more subsystems further comprises:

controlling the one or more power sources to meet a power demand of the hydraulic fracturing system.

16. A method, comprising:

monitoring an operation or a state of one or more subsystems of a hydraulic fracturing system, wherein the hydraulic fracturing system comprises:

one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, one or more missile valves fluidly connected to inlets and outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves;

controlling, based on monitoring the operation or the state, the one or more subsystems within operating limits or based on operating expectations to cause or prevent an occurrence of one or more well integrity-related events; and optimizing the operation or the state of the one or more subsystems of the hydraulic fracturing system using a particle swarm algorithm, wherein the optimizing of the operation or the state further comprises:

optimizing the operation or the state of the one or more subsystems according to one or more objectives comprising at least one of:

minimizing fuel consumption of the one or more subsystems, maximizing an operational life of equipment of the one or more subsystems, minimizing a cost of operation or ownership of the one or more subsystems, minimizing emissions of the one or more subsystems, or maximizing maintenance intervals of the one or more subsystems.

17. A controller for a hydraulic fracturing system, the controller being configured to:

monitor an operation or a state of one or more subsystems of the hydraulic fracturing system, wherein the hydraulic fracturing system comprises:

one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, one or more missile valves fluidly connected to outlets of the one or more fracturing rigs, one or more zipper piping and zipper valve sets fluidly connected to outlets of the one or more missile valves, one or more well head valves fluidly connected to outlets of the one or more zipper piping and zipper valve sets, and one or more well heads fluidly connected to outlets of the one or more well head valves; and control, based on monitoring the operation or the state, the one or more subsystems, within operating limits or based on operating expectations, to cause or prevent an occurrence of one or more well integrity-related events, wherein the one or more well integrity-related events to be caused include at least one of:

a well pressure meeting or maintaining a minimum well pressure, the well pressure being within a range of pressure values, an operation speed of the one or more subsystems meeting or maintaining a minimum operation speed, or the operation speed being within a range of speed values, and wherein the one or more well integrity-related events to be prevented include at least one of:

the well pressure exceeding a pressure limit, a well collapse, stalling of the one or more subsystems, or a deviation from a fracturing schedule.

18. The controller of claim 17, further configured, when monitoring the operation or the state, to:

monitor the operation or the state of the one or more blending equipment; and wherein the controller is further configured, when controlling the one or more subsystems, to:

control the one or more blending equipment to prevent the hydraulic fracturing system from falling below a low pressure limit of the hydraulic fracturing system.

19. The controller of claim 18, further configured, when monitoring the operation or the state, to:

monitor the operation or the state of pumps of the one or more fracturing rigs; and wherein the controller is further configured, when controlling the one or more subsystems, to:

control the pumps based on the monitoring.

20. The controller of claim 17, further configured to operate in one or more operational modes, the one or more operational modes comprising a multi-site mode in which the controller monitors operations of multiple hydraulic fracturing systems.

* * * * *